US006079904A

United States Patent [19]

Trisl

[11] Patent Number: 6,079,904

[45] Date of Patent: Jun. 27, 2000

[54] TRANSPORTABLE COLLAPSIBLE PROTECTIVE BARRIER, ESPECIALLY AGAINST HIGH WATER

[75] Inventor: Klaus Trisl, Wiesbaden, Germany

[73] Assignee: Arttec Innovation Trade GmbH, Wiesbaden, Germany

[21] Appl. No.: 09/007,116

[22] Filed: Jan. 14, 1998

[30] Foreign Application Priority Data

Jan. 15, 1997 [DE] Germany ..... 197 01 126

[51] Int. Cl.[7] ..... E02B 3/10; E02B 7/02

[52] U.S. Cl. ..... 405/107; 405/71; 405/72; 405/112; 405/116

[58] Field of Search ..... 405/14, 70–72, 405/107, 112, 115, 116

[56] References Cited

U.S. PATENT DOCUMENTS

| | | | |
|---|---|---|---|
| 414,913 | 11/1889 | Lommer | 405/107 |
| 3,218,810 | 11/1965 | Grether et al. | 405/107 |
| 4,136,995 | 1/1979 | Fish | 405/115 |
| 4,648,752 | 3/1987 | Guy et al. | 405/14 X |
| 4,692,060 | 9/1987 | Jackson, III | 405/115 |
| 4,693,042 | 9/1987 | Villarreal | 52/169.14 |
| 5,470,177 | 11/1995 | Hughes | 405/115 |

FOREIGN PATENT DOCUMENTS

| | | |
|---|---|---|
| 383840 | of 0000 | Austria . |
| 0710747A1 | of 0000 | European Pat. Off. . |
| 195 11 559C1 | of 0000 | Germany . |
| 195 18 791A1 | of 0000 | Germany . |
| 2842353C2 | of 0000 | Germany . |
| 295 04 288 U1 | of 0000 | Germany . |
| 3417533A1 | of 0000 | Germany . |
| 3607790A1 | of 0000 | Germany . |
| 4409304A1 | of 0000 | Germany . |
| 7510118 | of 0000 | Germany . |
| 8808124 U1 | of 0000 | Germany . |
| 8810857 U1 | of 0000 | Germany . |
| 9013659 U1 | of 0000 | Germany . |
| 9412740 U1 | of 0000 | Germany . |
| 2013726 | 3/1970 | Germany . |
| 4439754 | 10/1994 | Germany . |
| 358459 | of 0000 | Switzerland . |
| 687334 | of 0000 | Switzerland . |
| 584 812 | 6/1977 | Switzerland . |
| 2228510 | of 0000 | United Kingdom . |
| 2243393A | of 0000 | United Kingdom . |
| 2 269 618 | 2/1994 | United Kingdom . |
| WO97/07290 | 2/1997 | WIPO . |

OTHER PUBLICATIONS 3 page German Search Report Citing Ablove References—Dated Sep. 16, 1996.

German Search Report dated Sep. 16, 1997.

P. 15–13 Nov. 13, 1995—ENR "Denver's Bag System Finally Nears Finish".

European Search Report dated Dec. 11, 1998.

*Primary Examiner*—David Bagnell

*Assistant Examiner*—Tara L. Mayo

*Attorney, Agent, or Firm*—Reising, Ethington, Barnes, Kisselle, Learman & McCulloch, P.C.

[57] ABSTRACT

The transportable, foldable protective barrier, especially against high water, contains a series of supports of supporting elements articulately joined with one another, a number of parallel pipe rods for the joining of the supports as well as a number of reinforcement filling elements for the bridging of the gaps between the pipe rods. The supports are unfolded into bracing triangles and joined with the pipe rods which span a plane which are completed by grids or panels as reinforcement filling elements. Over the supports and the reinforcement filling elements panels are laid in the event of (a need for) high water protection.

22 Claims, 11 Drawing Sheets

TRANSPORTABLE COLLAPSIBLE PROTECTIVE BARRIER, ESPECIALLY AGAINST HIGH WATER

FIELD OF THE INVENTION

The invention relates to a transportable, foldable protective barrier, especially against high water, comprising a plurality of supports which may be folded and unfolded.

BACKGROUND OF THE INVENTION

There are many types of high-water protective devices, which can be roughly classified according to whether they lean on existing buildings or form a wall in the terrain. In these walls there are forms of execution with solid supports in the nature of cutoff walls and fixed frames, and there are forms of execution with support elements foldable together. The invention has to do with the latter form of execution.

A protective barrier according to the kind referred to above is known from U.S. Pat. No. 5,470,177, in which the support is constructed from three struts which are joined articulately with one another at one end while each of their other ends they are hinged to a respective support pad. The support pads fit into pockets of a ground seal-off arrangement. The stowage wall surface is formed by double-layered struts, over which a tarpaulin is drawn. The struts form a concave curvature on the stowage wall surface and can stand very close together in order to keep the sagging of the tarpaulin slight. Over the tarpaulin there can be suspended plates of woven polymeric material overlapping in scale form, possibly for purposes of reinforcement. As height of the barrier there is specified 8 feet=2.4 m and as stowage height 7.5 feet=2.28 m. What is disadvantageous in the known protective barrier is the relatively great storage space for the folded-together parts, because very many supports are used, which stand relatively close together, in order to support the sheet.

In a further known stowage wall (DE 28 42 353) there is provided a series of triangular supporting devices which directly support a tarpaulin. The tarpaulin extends also in front of the foot of the stowage wall and has there a shorter length for the avoidance of folds, while the tarpaulin forms domed folds between the supports, in order to absorb the water pressure. The spacings between the supports are small and, accordingly, the number of supports is great, for which reason a relatively large stacking space is required. The supports, moreover are not described as foldable together.

In a further known protective wall (DE-U 88 08 124) there is presumed a U-shaped gutter to be lowered in the ground, into which large plates are installable, which are supported in each case over obliquely running supports on the ground. These supports can be swung into the plane of the plates, in order to reduce the storage volume of the protective wall. Nevertheless, a relatively large storage volume is required.

In a further known support barrier (commercial announcement in ENR/Nov. 13, 1995) conversely Y-shaped steel carrier frames are provided, over which a textile membrane is laid which continues also over the ground. As stowage height there is mentioned 9 feet=2.7 m.

SUMMARY OF THE INVENTION

Underlying among the objects of the invention is to provide a transportable, foldable protective barrier, with which a relative high stowage height is achievable, which can be used flexibly and which, when not in use, is foldable together and can be stacked in narrow space.

In accordance with the present invention there are provided a series of supports, a number of connecting elements, a number of reinforcing filling elements and—in the case of high water protection—one or more tarpaulins, from which the protective barrier is assembled. The supports consist of supporting elements articulately joined with one another, which can be folded together to save space and are unfolded for the use state, in which supporting triangles are built. The supports are joined with one another over pipe rods as connecting elements, and for this purpose the supports have receptacles for the ends of the pipe rods. The spacing between the supports corresponds in order of magnitude to the height of the supports and is bridged by three or more pipe rods, the interspaces of which are further reduced by the reinforcement filling elements, so that the tarpaulin cannot be too severely deformed by water pressure or the like. In this manner there is created an attuned system for the support of the tarpaulin, which ultimately, in the event of high water, has to seal off the stowage wall surface. The forces are transferred from the tarpaulin over the reinforcement filling elements onto the pipe rods and from there onto the supports, which lead off the forces into the ground. The elements can be arranged and dimensioned in such manner that the specific load for like materials is about equal everywhere.

Each supporting element has a U-shape section and has, therefore, a main plane and two lateral flanges. The flanges serve for the reinforcement and for the reception of the pivot axes.

With supports set up, support triangles are formed, and locking bolts are inserted into bores in the flanges of support element and stowage wall element in order to secure the construction.

In the case of transport or storage of the supports these are laid together in such manner that the main planes of the supporting elements run parallel to one another with close spacing. The folded support then has a block-form geometry. The flanges of the supporting elements are joined with one another by the blocking bolts, and the folded-together support is secured in order to prevent any undesired unfolding. This is especially important when the folded-together posts are dropped off from transport vehicles at the particular site of erection.

The receptacles for the pipe rods are formed by pipe sections or shells running parallel to one another which run between openings of the flanges of the stowage wall element and are joined with these, for example welded. For the fixing of the pipe rods inserted into the receptacles there can be used clamping screws which are seated in the wall of the reception shells.

The number of pipe rods per support is governed according to the height of the support. There are used at least three, preferably four or more pipe rods running parallel to one another.

The pipe rods span a plane along which the panels and/or grids run. The panels themselves consist of aluminum or galvanized sheet steel and have a bent-over longitudinal edge in order to make it possible to hang them over the uppermost pipe rod of the basic structure.

In the case of high water protection, watertight tarpaulins arrayable along the panels are usable, which are fastened to their respective upper edge and are weighted by weights on the ground side.

Adjoining panels bounding on one another are arranged overlapping in their side edges and joined watertightly with one another in the overlapping zone. For this the overlapping zone can be made double-layered, i.e. they can have additional tarpaulin material strips with watertight adhesive or tearing closures. For the mechanical joining of the side edges of the tarpaulins there are arranged eyes on one side edge and loops on the other, which are put together with a strap or a lash inserted through the loop. The upper edges of the tarpaulins can be bound to the basic structure. For this the upper longitudinal edges of the tarpaulins are constructed in tubular form in order to receive a spanning rope. Further, eyes are arranged there through which rubber bands can be drawn and lashed to the basic structure.

As weights there can be used sandbags. It is also possible, however to use especially constructed weight bodies which can be stuck together.

Frequently the gap between ground and tarpaulin must be sealed. For this a sealing strip of foam rubber, silicon material or the like can be provided. Also tube material is usable in order to ensure the necessary sealing between the tarpaulin and the ground.

The protective barrier can also be set up lengthwise by arches. For this the protective barrier has curve parts. These contain arcuate pipe rods between adjacent supports and trapezoidal panels as reinforcement filling elements. Adjacent trapezoidal panels can be coupled with one another over hinges. With grids as reinforcement filling elements, the basic structure can be used as a catching device for fuel or drifting matter.

Aside from this, the arrangement according to the invention can serve, besides the screening function, also as carrier of advertising surfaces. Also, the arrangement can be constructed as a barrier in sports events, as landslide protection or insurance against dune-formation.

The arrangement of the invention can be simply set up or taken down and requires only a small space for its storage.

BRIEF DESCRIPTION OF THE DRAWINGS

Further details, advantages and features of the invention are yielded not only from the claims, the features to be derived from these, by themselves and/or in combination, but also from the preferred embodiments to be derived from the drawing and the following specification.

DETAILED DESCRIPTION OF THE PREFERRED EMBODIMENTS

In the figures substantially like elements are provided with the same reference numbers. With the aid of the protective barrier zones are to be protected or secured. Among these there fall high water protection, drift matter grids, blocking-off of areas at sports events, snowdrifts or landslides protection, dune protection or the like.

Figure 1:
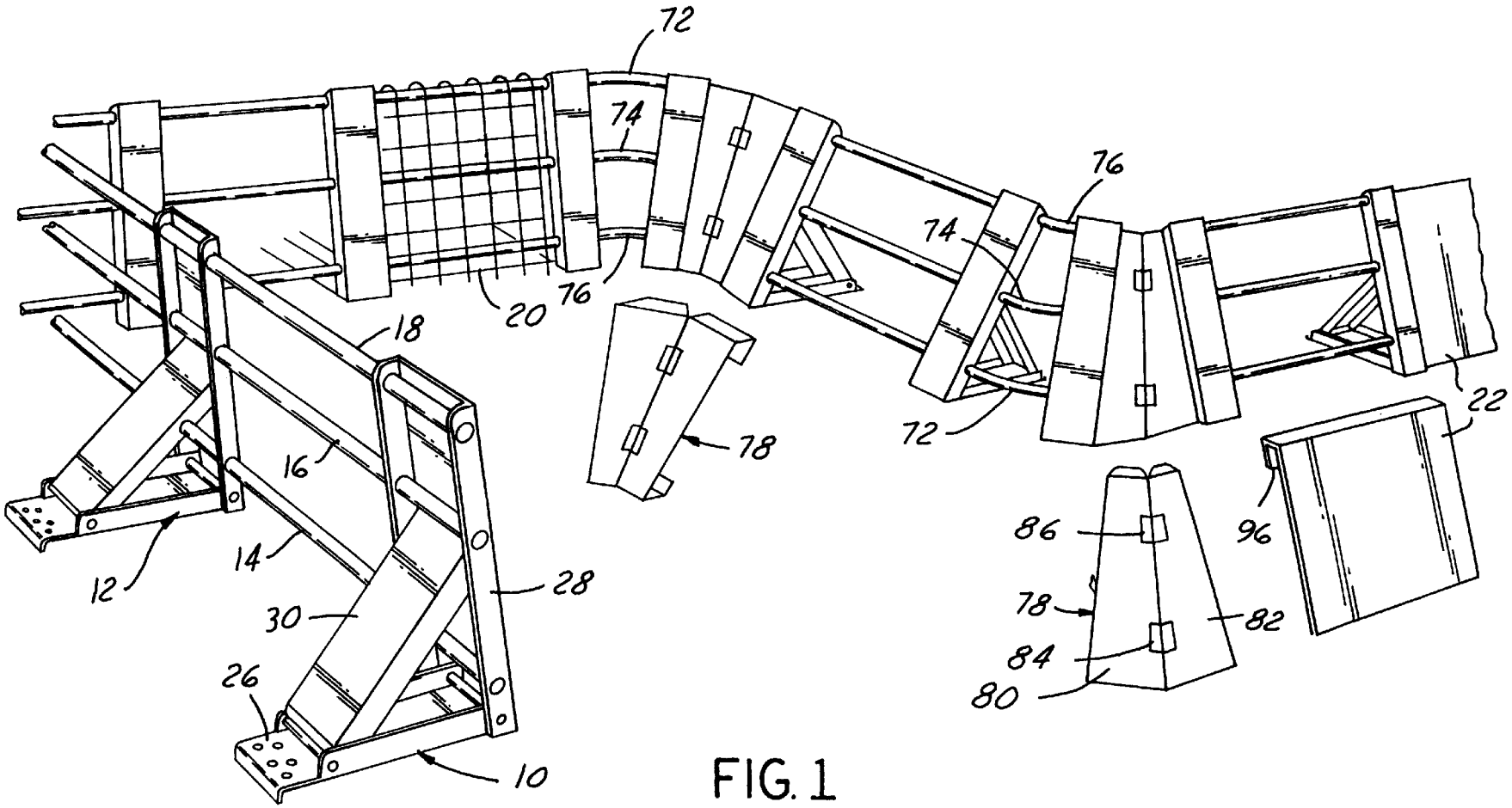
FIG. 1 shows a perspective view of a framework of a protective barrier.
Figure 2:
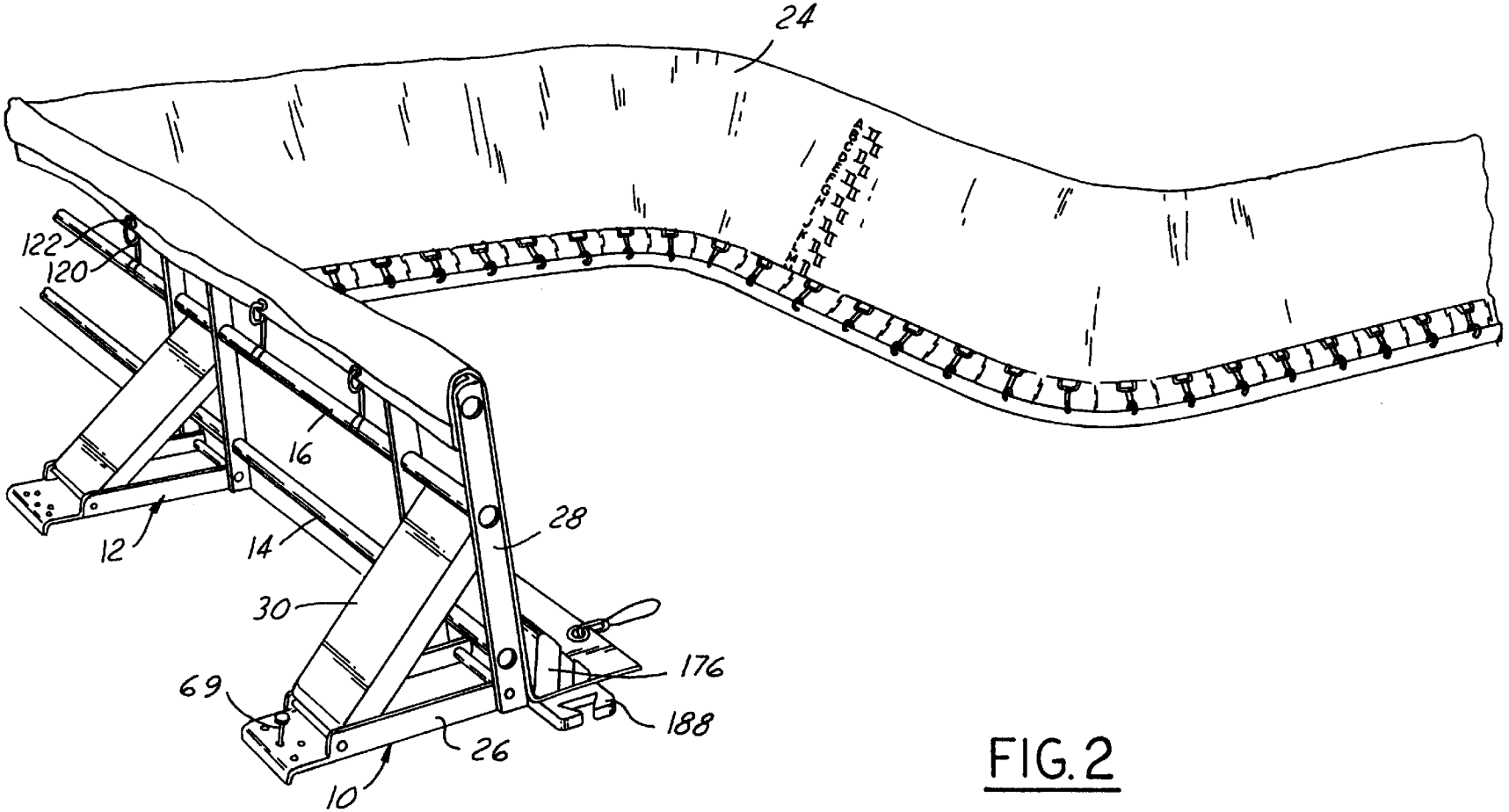
FIG. 2 the protective barrier in the mounted state

In FIG. 1 the holding and supporting elements are represented and in FIG. 2 the complete protective barrier is shown. According to the course of this protective barrier supports or posts 10, 12 are set up a predetermined distances apart: in the example of execution represented these spacings are greater along straight stretches and smaller along curvatures. The supports 10, 12 are joined with one another over pipes or pipe rods 14, 16, 18, which run parallel to one another and span a supporting plane. The gaps between the pipe rods 14, 16, 18 are still rather large and are filled out by reinforcement filling elements which can take on the form of grids 20 or of sheet metal panels 22. In the case of high water protection there is laid in addition a watertight tarpaulin 24 (FIG. 2) over the basic structure in order to seal off the stowage wall surface described.

The supports or posts 10, 12 consist of three main supporting elements, namely an elongated plate-form bottom element, an elongated plate-form stowage wall element 28 and an elongated plate-form bracing element 30, which can be arranged to one another to form a bracing triangle. The triangle sides are articulately connected with one another and extend in part beyond the base triangle. The bottom element 26 forms the base on the one end of which the stowage wall element or the outer shank 28 is articulated, and near the other end of which the bracing element or the supporting shank 10 is articulated. The bracing element 30 engages about in the middle of the storage wall element and leads the pressure force arising there obliquely onto the ground element 10 and therewith into the ground.

As is best evident from FIGS. 9 to 12, the ground element 26, the stowage wall element 28 and the bracing element consist of flange-reinforced panels which thus present a U-shaped cross section. The flanges of the elements 26, 28, 30 are produced by bending-off of the sides of sheet metal panels. There can also be used sections of profile material. The dimensions of the elements 26, 38, 30 are such that the U-forms are stackable in one another, as is best evident from FIG. 11. The bracing element 30 fits into the bottom element 26 and this in turn fits into the stowage wall element 28.

For the joining of the supports 10, 12 among one another the stowage wall elements 28 have receiving arrangements 32 for the ends of the pipe rods 14, 16, 18. The receiving arrangements 32 are formed by sleeves or pipe pieces which extend between the flanges 34, 36 of the stowage wall element 28, and their openings are designated with 38, 40, 42, 44, 46, 48. The outer form and size of the pipe rods 14, 16, 18 is adapted to the inner form of the receptacles 32, i.e. the ends of the pipe rods can be coupled by insertion into the receptacles with the stowage wall elements 28. The receptacle sleeves 32 can contain in each case cross pins or splints in order to form a stop for the pipe rods 14, 16, 18 on their insertion. In the wall of the receptacle sleeve 32 there can also be arranged clamping screws in order to firmly clamp the inserted ends of the pipe rods.

In the drawings, two possibilities for the articulate connection between the supporting elements 26, 28, 30 are represented, namely by means of axes 33, 35 which are borne in the flanges 34, 36 and 52, 54 or 60, 62 of the supporting elements 26, 28 30, or screw bolts 37 are used as axial pins, which pass through in each case adjacent flanges 52/60 and 54/62. The articulate joining makes possible the folding-together of the supporting elements, in which their elongated panels come to lie close together, as can be visualized on the basis of FIG. 11. This folded-together state can be ensured by locking bolts 57 which are inserted through transverse bores 56, 58 aligned with one another of the flanges. This transport insurance is especially important in the loading and unloading.

Figure 3:
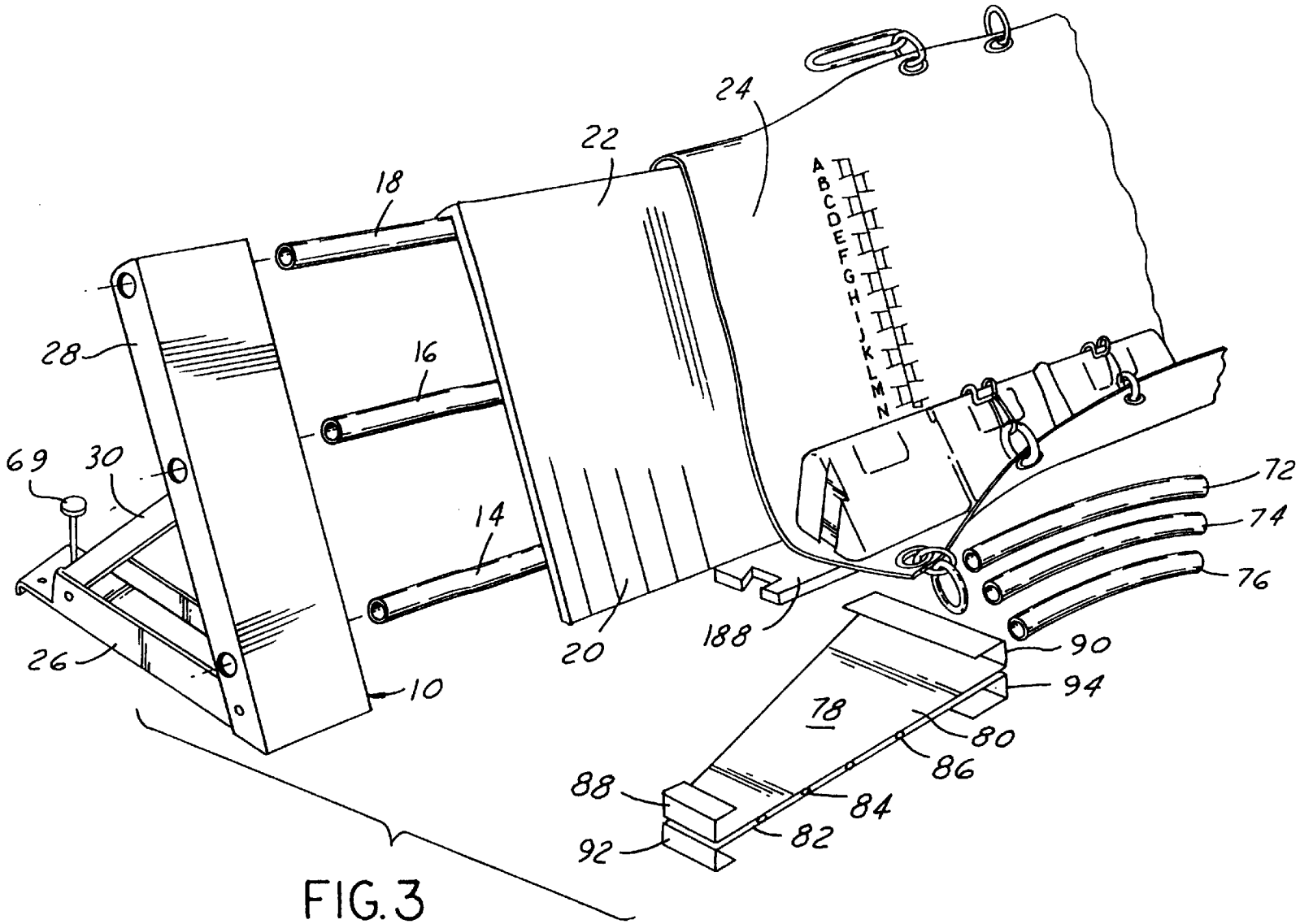
FIG. 3 details of the arrangement according to FIGS. 1 and FIG. 2.

The bottom element 26 can be pierced with interruptions 68 in order to make possible a fastening to the ground with nails 69 (FIGS. 2, 3). For these interruptions 68 there can be provided a fastening section 66 (FIG. 12), which can extend for more comfortable accessibility to beyond the hinging place. It is also possible to bend over or chamfer the free edge of the element as represented at 70, in order to achieve an additional anchoring in the ground.

As FIGS. 1 and 2 make clear, the protective barrier can run along curvatures. In a curve or corner zone the posts or supports 10, 12 are joined among one another over correspondingly curved pipe rods 72, 74, 76. For a changed arc course the pipe rods 72, 76 can be exchanged. In the corner zone there are provided as reinforcing elements, for example, corner plates 78 which consist of two panels 80 82 (FIG. 1), which are joined among one another over hinges 84, 86. Each panel 80, 82 has a trapezoidal contour with hook-shaped longitudinal borders 88, 90, 92, 94, behind which the pipe rods 72, 76 are received.

If the stowage wall surface runs with an inner curve, then the longitudinal edges 90, 94 are suspended on the upper side on the pipe rods 72. In the case of an outer curvature the narrower edges 80, 82 are suspended at the top on the pipe rods 76. Accordingly a universal use of these reinforcement filling elements is possible with curvatures of the protective barrier.

In the straight-running sections of the protective barrier the sheet metal panels 22 are chamfered or bent only on an upper edge 96. It is also possible to use fully flat sheet metal panels 22, therefore without bent-over edge 96. Such fully flat sheet metal panels can be fastened with clamps or clips to the upper pipe rods 18.

For high water protection, tarpaulin 24 are used on the basic framework described. The tarpaulins consist of tear-proof and water impermeable plastic fabric or foil. The upper edges of these tarpaulins 24 are secured to the basic framework by means of bands 120 which have a loop end, so-called "slings", (FIG. 2). The edges are double-layered and have eyes 122.

Figure 13:
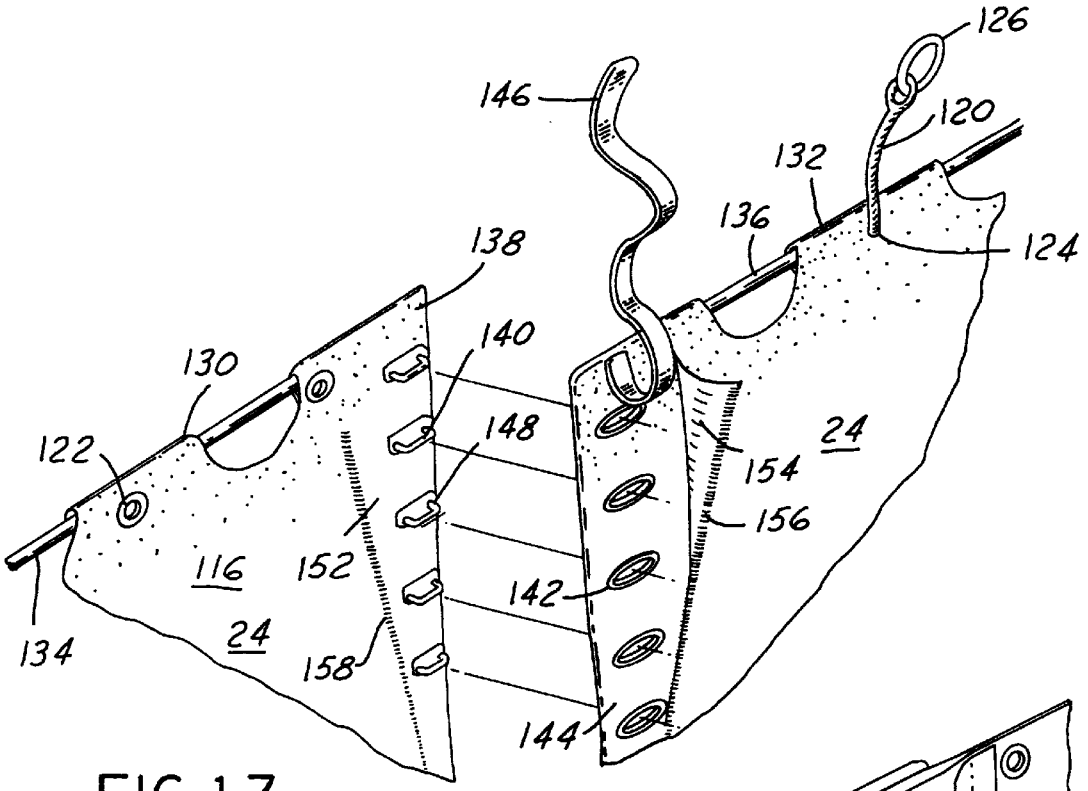
Figure 15:
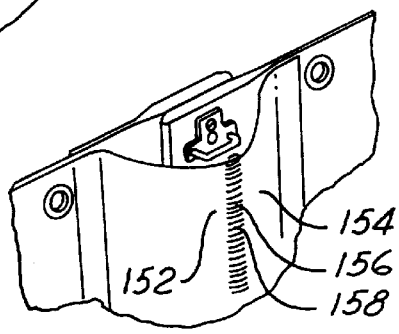
Figure 14:
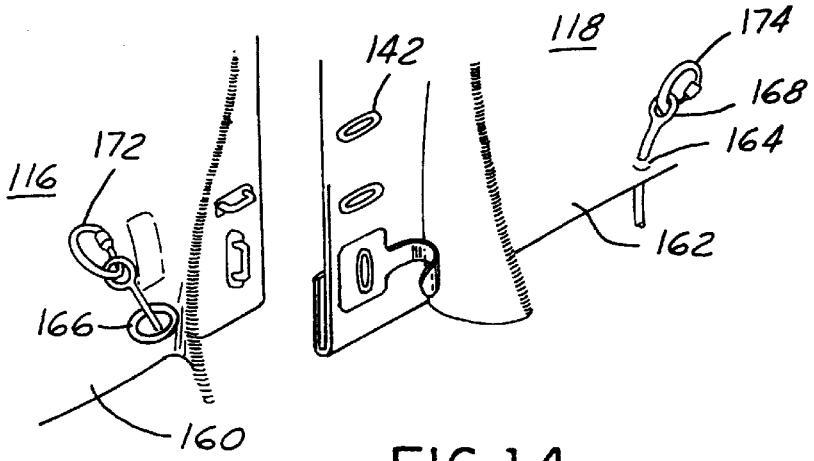

Adjoining border sections 116, 118 of the tarpaulins 24 are represented in FIGS. 13, 14, 15. The upper border sections 130, 132 of these tarpaulins are reinforced in a special manner, namely by ropes 134, 136 which run through the tubularly constructed border sections 130, 132.

The adjoining tarpaulins 24 can be joined with one another by overlapping loop-and-eye connections. For this in the example of execution loops 140 proceed from the side border 138 of the tarpaulin 24, which (loops) can be inserted into corresponding eyes 142 in the side edge 144 of their tarpaulin 118. Thereupon a flat strap 146 can be drawn through the openings of the loops in order to join the tarpaulins 24 with one another with tensile strength. In order to preclude the possibility that water can penetrate in region of the side border, it is possible to apply adhesive strips over the gaps between the tarpaulins. Alternatively it is possible to use a waterproof zipper fastener 156, 158 which is joined in flat strips 152, 154 with the respective tarpaulins 24 by, for example, vulcanization or cementing.

In the bottom longitudinal border zone 160, 162 of each tarpaulin 24 there are likewise admitted eyes 164, 166 which are penetrated by further connecting elements 168, 170. Here it can likewise be a matter of rubber slings with safety hooks 172, 174 at the ends, which are connectable, in correspondence to FIG. 5, to weight elements 176, and, namely, with grips 178 proceeding from these. The weight elements 176 are emplaced there on the tarpaulins 24 in their lower end zones and partially wrapped by these, as is likewise clarified in FIG. 5.

Figure 7:
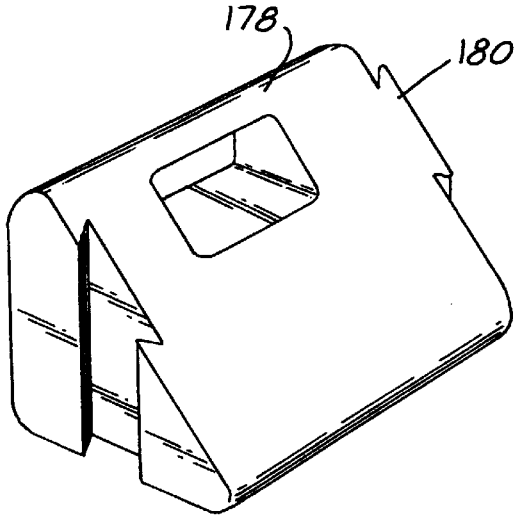
Figure 8:
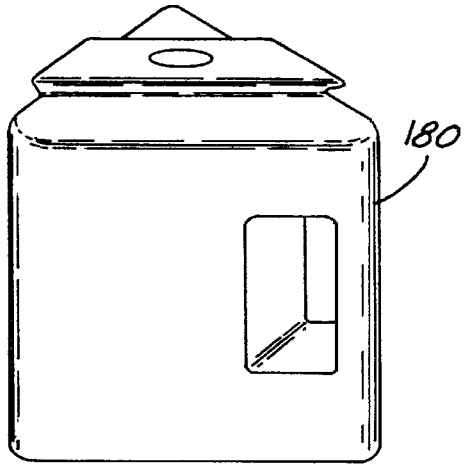
Figure 9:
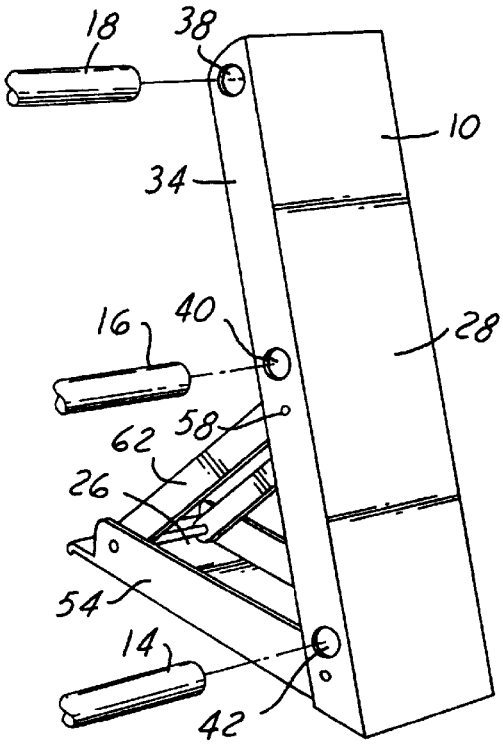
Figure 10:
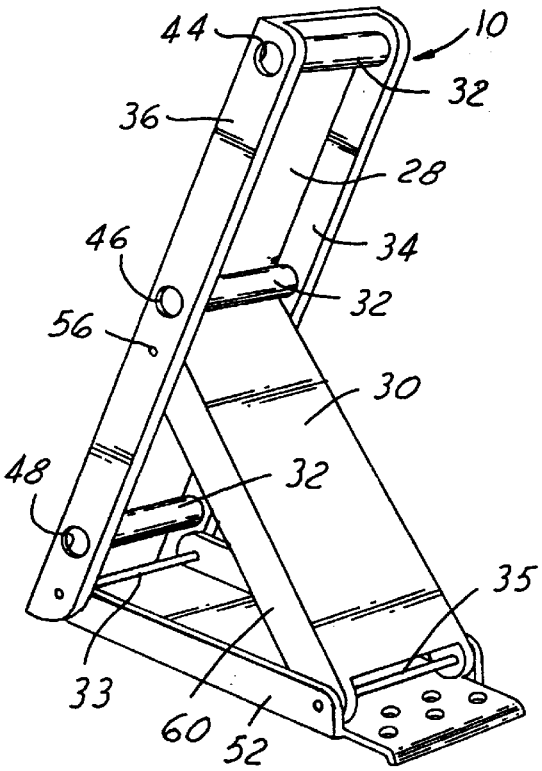
Figure 11:
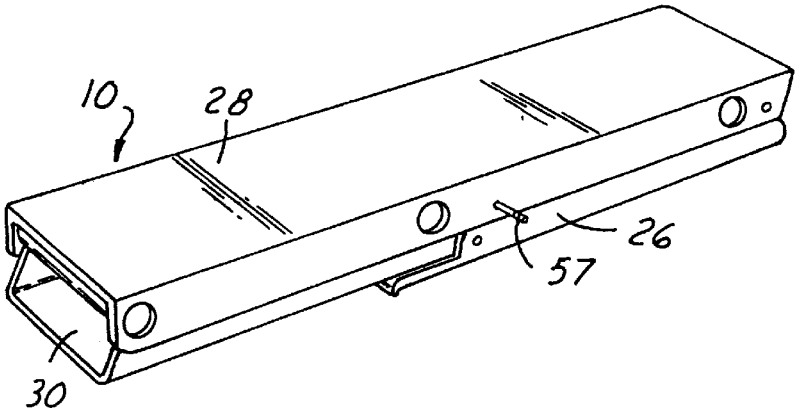
Figure 12:
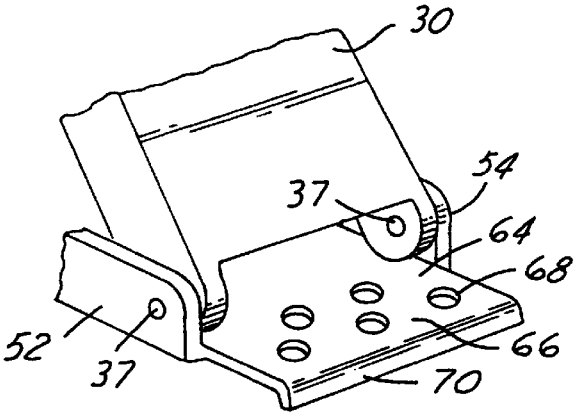

With the weight elements 176 it can be a matter of concrete blocks (FIGS. 5, 6) or of filled plastic hollow bodies 180 (FIGS. 7, 8). The latter are filled with sand and water. The weighting of the edge of the tarpaulin prevents this edge from being lifted (washed up") when the high water barely reaches the foot of the protective barrier. At a high water level the foil is pressed sufficiently strongly and does not need to be weighted down.

The weight elements 176, 180 have the form of a three-edged column, in which the outer surface 184 extends along the ground and the outer surface 186 extends along the tarpaulin 22.

Figure 4:
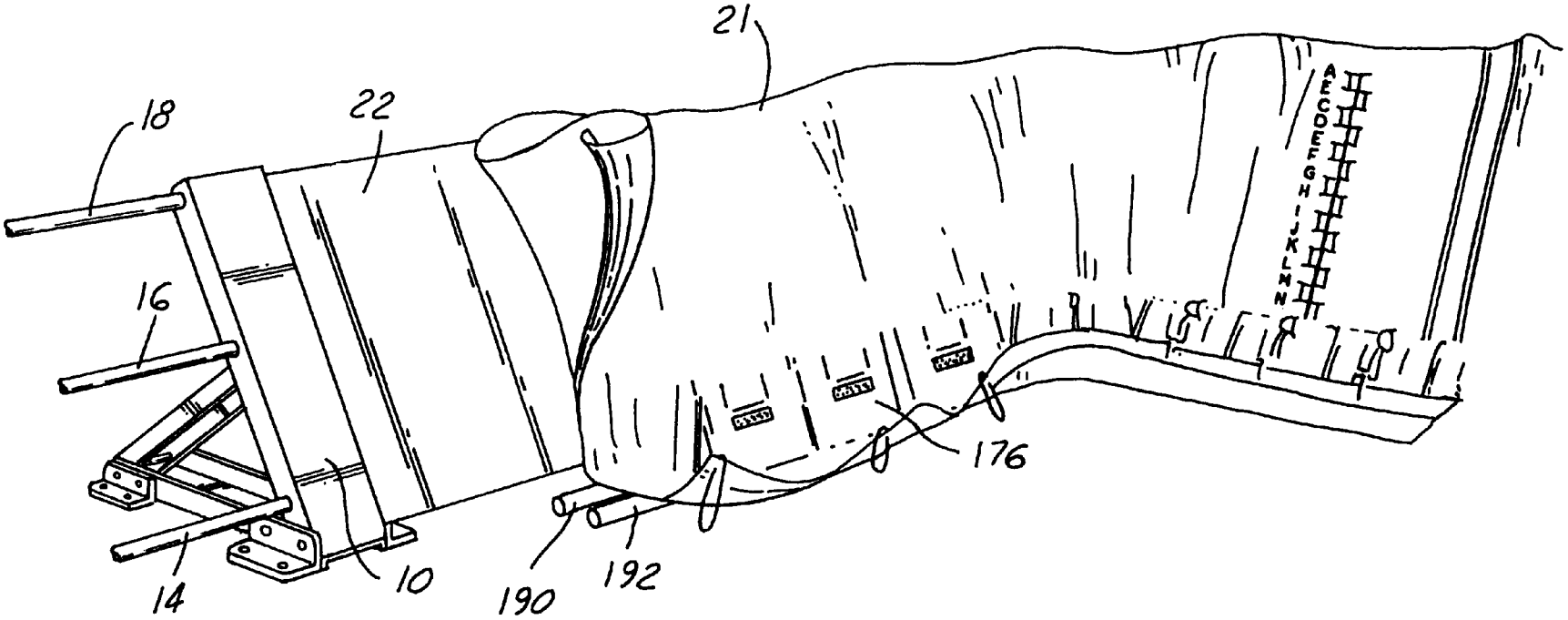
FIG. 4 details of an alternative form of execution of the sealing with respect to FIG. 3, FIG. 5 details of a fastening of a tarpaulin, FIG. 6 a weight suited for the fastening of a tarpaulin, FIG. 7 a further form of execution of a weight FIG. 8 an edgewise representation of the weight according to FIG. 7, FIG. 9 a front view of a support FIG. 10 a rear view of the support according to FIG. 9, FIG. 11 the support according to FIGS. 9 and 10 in the folded-together state, FIG. 12 a detail of the support according to FIGS. 9 to 11, FIG. 13 detail in the connecting zone of tarpaulins, FIG. 14 further details in the connecting zone of tarpaulins, FIG. 15 an overlapping of tarpaulins, FIG. 16 a protective barrier as high water protection, FIG. 17 a protective barrier as a sports field boundary, FIG. 18 a protective barrier against snow drifts or plumes, FIG. 19 a container for the reception of elements of the protective barrier according to FIGS. 1 and 2, and FIG. 20 to FIG. 22 illustrate a further form of execution of the supports as seen in perspective.

In order to make sure that the liquid cannot flow through under the tarpaulins 22, the weights 176, 180 together with the tarpaulins 24 are emplaced on a sealing underlayer, which consists of strip material or foam substance strips 188 (FIG. 3) or of tubes 190, 192 (FIGS. 4, 5), in order to create a level compensation between the ground and the weights 176, 180 and to fill out gaps. With the sealing underlayer it can be a matter, for example, of foam rubber, of a silicon material or the like. With use of plastic foil as tarpaulin material and long projecting length on the ground, with a sufficiently level ground, no additional sealing underlayer 188, 190, 192 is needed.

Figure 5:
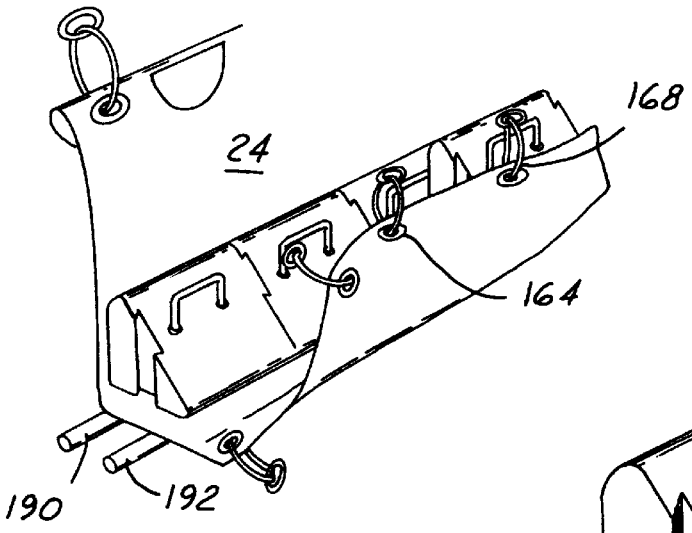
Figure 6:
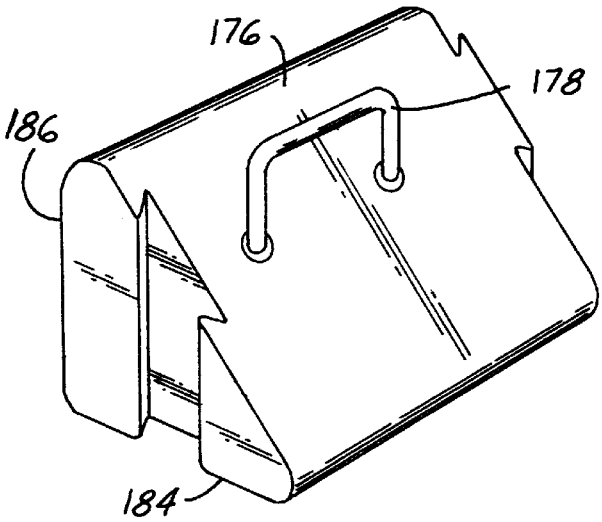

As FIG. 5 shows, the weights 176 are arrayed on one another in the manner of a chain, but press individually on their underlayer, in order to press this uniformly onto the ground and to preclude hollow places. For this purpose, swallowtail constructions running parallel to the extension direction of the weights 176, 180 are provided. Obviously it is also possible to use sandbags for the loading of the lower edge of the tarpaulins.

While in the example of execution the weight elements 176 are emplaced on these tarpaulins 24 in their lower border zones and then partly surround the tarpaulins 24, there is also the possibility that the weights 176, 180 can be introduced into pockets present on the bottom side of the tarpaulins 24.

The sealing of the edge of the tarpaulins 24 to the ground is all the better, the higher the water pressure is. The sealing-off, therefore, is more critical with low water than with a higher water level.

Figure 20:
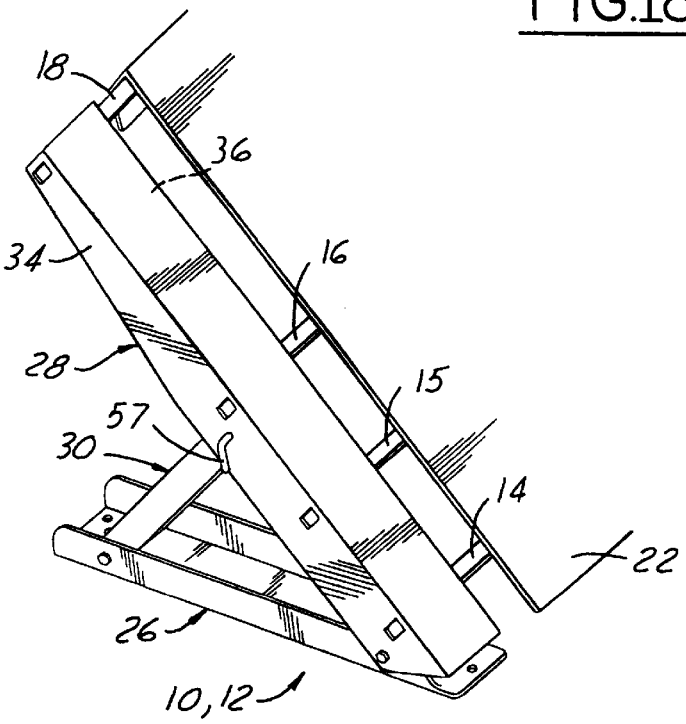
Figure 21:
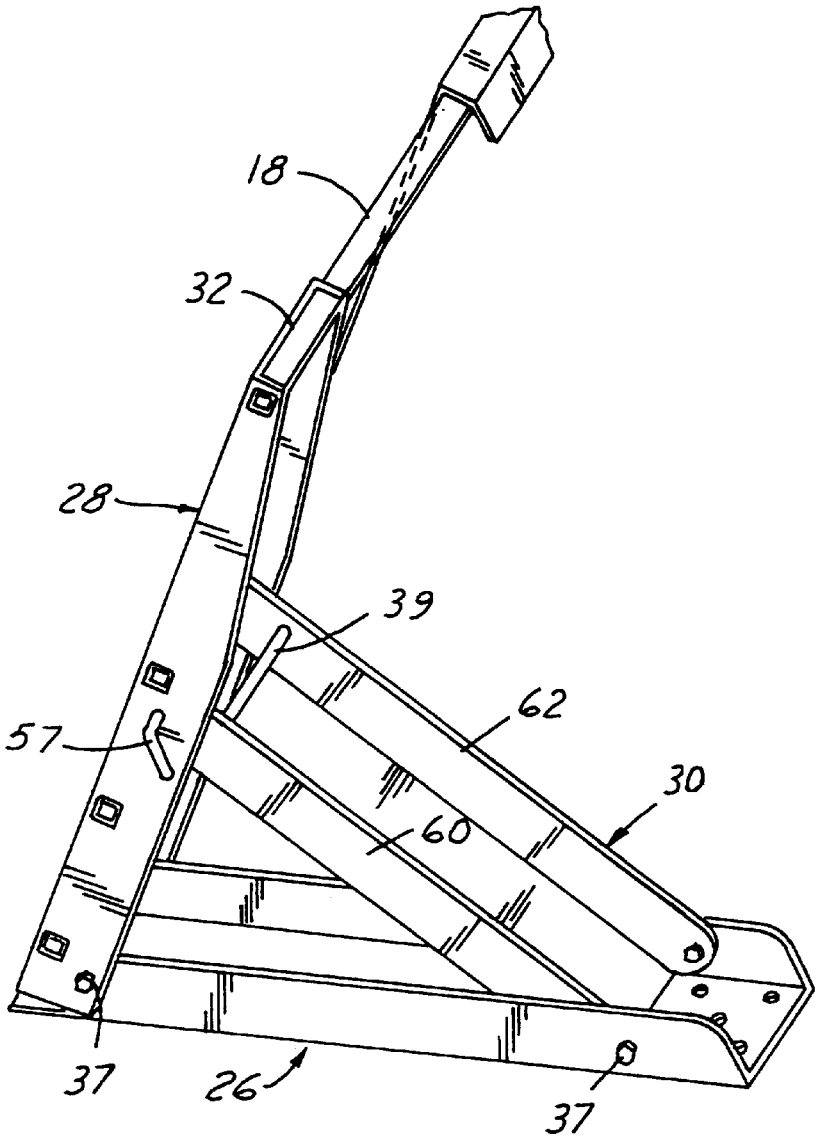
Figure 22:
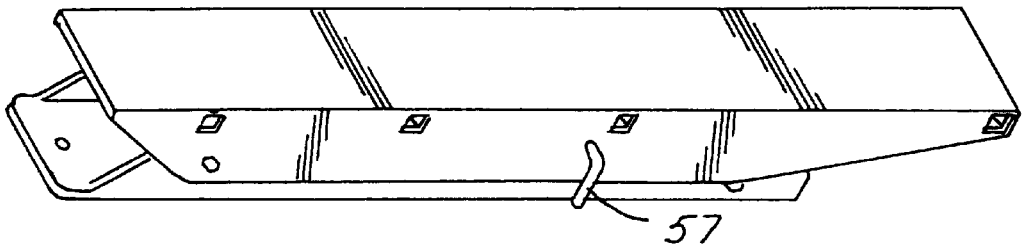

Instead of the a round pipe, a rectangular pipe can also be used for the connecting elements, as represented in FIGS. 20, 21 and 22. With rectangular pipe there can be achieved a greater packing density in the stacking of the elements. If the rectangular pipe, in each case, is acted upon perpendicularly to two rectangular sides by the water pressure, as is the case in FIG. 2, then, incidentally, the rectangular shape is more favorable than the round shape for the absorption of the bending load.

Since the water pressure with set-up supports increases from above downward, the density of the distribution of the pipe rods 14, 15, 16, 18 is chosen increasing in downward direction; i.e. with increasing water pressure the spacings between the pipe rods decrease, whereby there is achieved a uniform loading of these pipe rods. The stowage wall element 28 is likewise loaded with increase from above downward, for which reason the flange length at the lower end of the element should be greater than at the upper end. As represented, the flanges 34, 36 are tapered in upward direction.

As FIG. 21 shows, it is favorable to direct the flange 60, 62 of the supporting member 30 upward, proceeding from the plate plane, in order to accommodate a rod 39 as hand grip, which is helpful in the setting up and taking-down of the support. With the supports described there can be achieved stowage heights of 3 meters and more.

Figure 16:
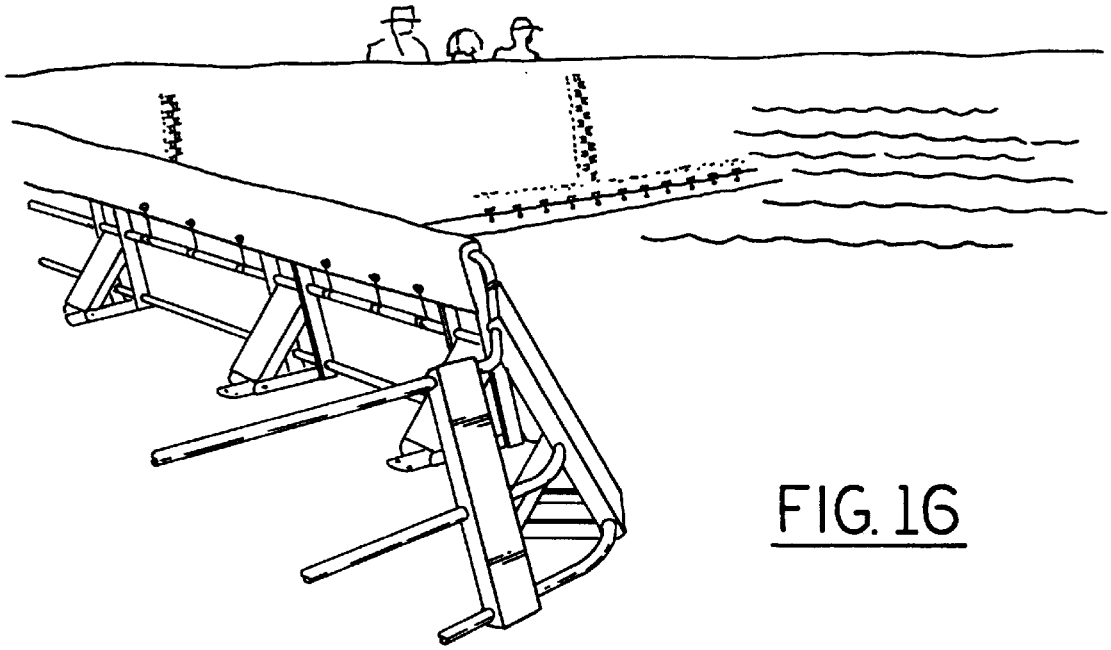
Figure 17:
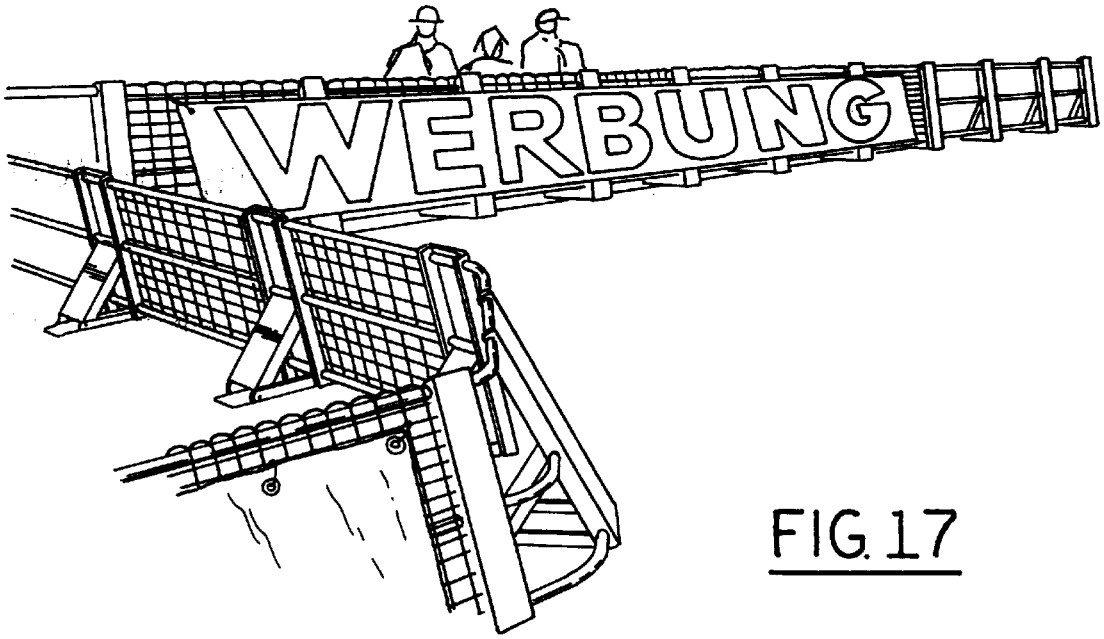
Figure 18:
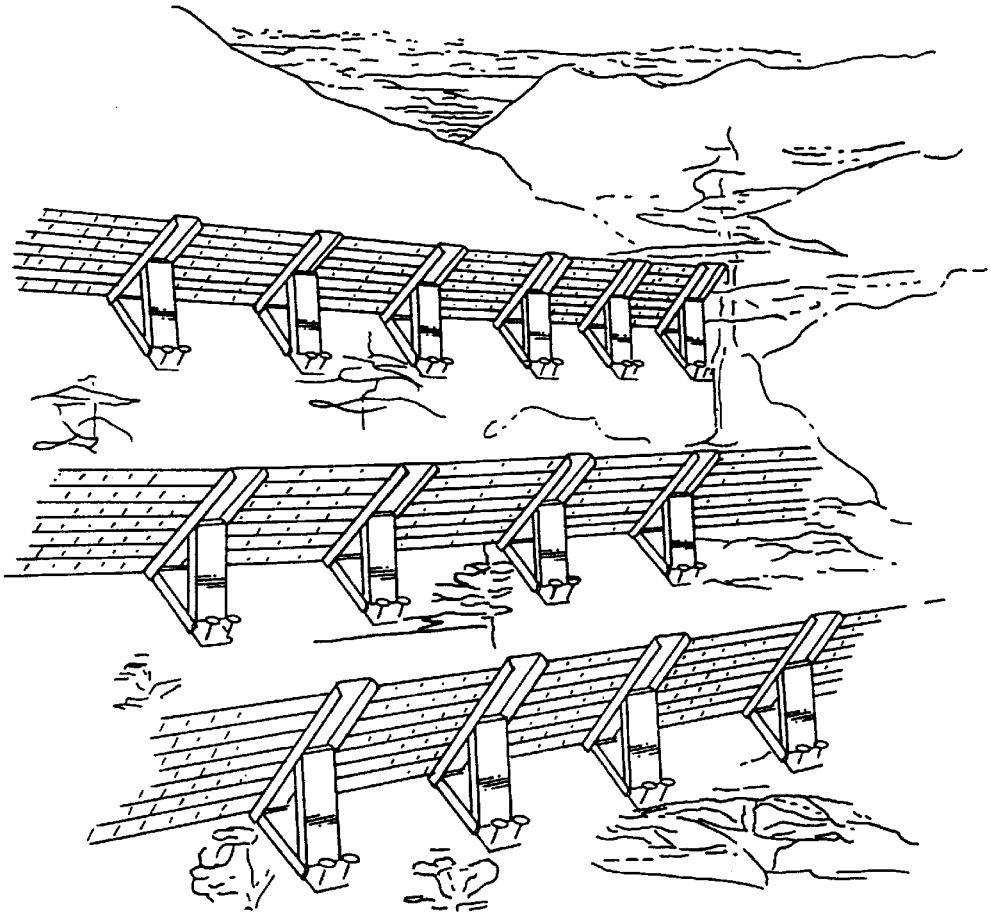

Use or application possibilities of the arrangement according to the invention described above are, purely theoretically, to be derived from FIGS. 16 to 18. Thus, in FIG. 16 there is constructed an arrangement as high water protection. In addition, tarpaulins running along the panels can serve as advertisements. From FIG. 17 it is also to be learned that between the posts or pipe elements there can extend also grids that can serve for the catching of drift material.

In FIG. 17 there is a barrier shown in which grid material runs along the pipes 14, 16, 18, that is intended, for example, as barricade for a sports event. Along the areas covered by the grids 20 there can then be stretched tarpaulins for the spanning wall advertising.

The arrangement according to FIG. 16 is suited, however, not only for high water protection but also for the enclosure of a sports pool or of a drinking water reservoir.

In FIG. 18 an arrangement according to the invention is represented as a safeguard against aimed. But the arrangement is suited also as a catching grid or a brake against rubble, stone, snow or rock-falls.

Figure 19:
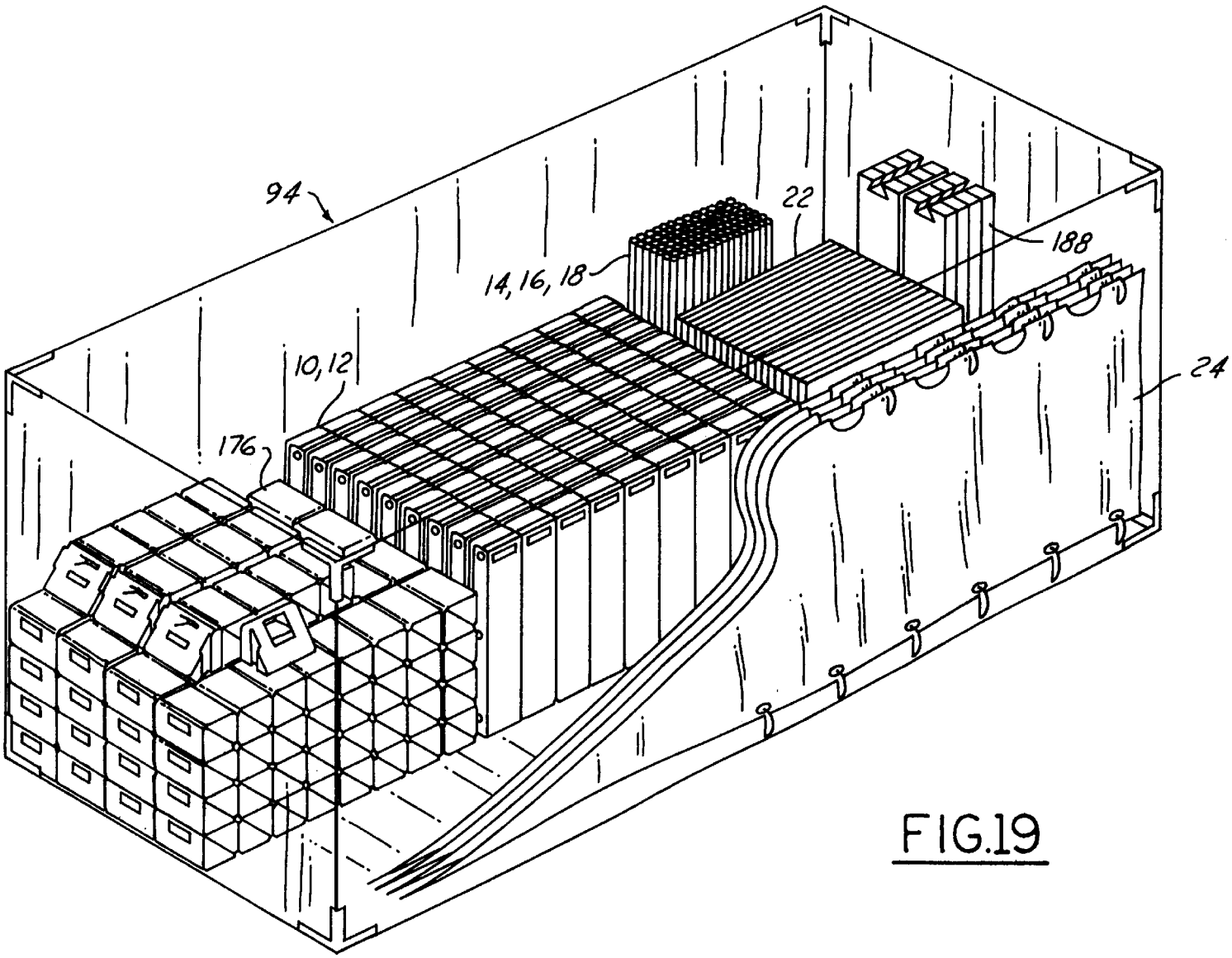

When the arrangement is not in use, the individual elements can be stored in a container 94 (FIG. 19). The representation of FIG. 19 makes it clear that a high packing density of the elements of the protective barrier is possible.

I claim:

1. A transportable, collapsible protective barrier, comprising:

a series of supports which consist of supporting elements articulately joined with one another, which are foldable together to save space and are unfoldable to form supporting triangles;

a number of connecting elements which are designed for the connecting of, in each case, adjacent supports;

a number of reinforcement filling elements in order to bridge interspaces between the supports;

the supports and the reinforcement filling elements define a stowage wall surface;

wherein the connecting elements are constructed as pipe rods parallel to one another which fix in each case a supporting plane and on which the reinforcement filling elements are braced and the supports contain receiving arrangements spaced from one another for the ends of the pipe rods in order to join adjacent supports firmly with one another.

2. A protective barrier according to claim 1, wherein the supporting elements comprise in each case an elongated plate-form shaped ground element, an elongated plate-form stowage wall element as well as a elongated plate-form bracing element, in which the stowage wall element has the receiving arrangements for the ends of the pipe rods.

3. A protective barrier according to claim 2, wherein the ground element is articulately joined near its ends with in each case at least one of an end of the bracing element and the stowage wall element.

4. A protective barrier according to claim 3, wherein the ground element has interruptions for the engagement of fastening elements to the ground.

5. A protective barrier according to claim 2, wherein the ground element, stowage wall element and bracing element have U-shaped cross sections with lateral flanges of such dimensions that the U-forms fit in one another, the bracing element fitting into the ground element and the ground element fitting into the stowage wall element.

6. A protective barrier according to claim 5, wherein transverse bores are provided in a covering zone of the lateral flanges in order to secure each of the adjacent elements in the unfolded and in the folded state by locking bolts that are inserted.

7. A protective barrier according to claim 5, wherein the receiving arrangements for the pipe rods are constructed as sleeves running parallel to one another, which run between the flanges of the stowage wall element, the flanges in the zone of the receiving arrangements having interruptions going over into these.

8. A protective barrier according to claim 2, wherein the stowage wall element is substantially longer than the ground element and that the ground element is constructed longer than the bracing element, the bracing element, with the supports, being coupled with its free end to the stowage wall element generally in the middle of the latter, so that about half of the stowage wall element extends freely upward.

9. A protective barrier according to claim 1, wherein between adjacent supports there extend at least three pipe rods running parallel to one another, which span a plane that runs parallel to the plane of the stowage wall surface.

10. A protective barrier according to claim 1, wherein among the reinforcement filling elements there are accounted sheet metal panels.

11. A protective barrier according to claim 1, wherein among the reinforcement filling elements there are accounted grid panels.

12. A protective barrier according to claim 1, wherein to the supports there also belong arcuate pipe rods and to the reinforcement filling elements there also belong trapezoidal plates in order to build up curved zones of protective barriers.

13. A protective barrier according to claim 1, which also comprises at least one tarpaulin for sealing off the stowage wall surface.

14. A protective barrier according to claim 13, wherein each tarpaulin has upper, lower as well as lateral borders, the lateral borders being designed for the watertight arraying on one another of the tarpaulins and on the respective upper and lower border fastening means being applied in order to secure these borders against slipping or lifting.

15. A protective barrier according to claim 14, characterized in that the joining tarpaulins are arranged overlapping in their lateral borders and are joined with one another in the overlapping zone and that on the overlapping zone sealing strips are provided in order to join adjoining tarpaulins watertightly with one another.

16. A protective barrier according to claim 15, wherein the sealing strips are joined with one another by means of a watertight zipper or slide closure.

17. A protective barrier according to claim 14, wherein the lateral borders are joined over hooks-and-eyes engaging in one another, a strap or a lash being drawn through the openings of the eyes.

18. A protective barrier according to claim 14, wherein the tarpaulins are made in tubular form in their upper border in order to receive a bracing rope.

19. A protective barrier according to claim 14, which also comprises ground sealing elements and weights in order to seal off the lower border of each tarpaulin against the ground.

20. A protective barrier according to claim 19, wherein the weights are in the form of a trihedral column, in which one side serves as weighting side and on or near the oppositely lying triangular apex a grip is mounted.

21. A protective-barrier according to claim 20, wherein the weights have coupling formations in order to be arrayed on one another in closed form.

22. A protective barrier according to claim 19, wherein the ground sealing elements contain foam rubber plates or strips.

* * * * *